United States Patent [19]

Pollock

[11] 4,361,357

[45] Nov. 30, 1982

[54] CHAIR

[76] Inventor: Charles R. Pollock, 34-24 86th St., Jackson Heights, N.Y. 11372

[21] Appl. No.: 142,249

[22] Filed: Apr. 21, 1980

[51] Int. Cl.[3] ..... A47C 3/00

[52] U.S. Cl. ..... 297/297; 297/349; 297/445

[58] Field of Search ..... 297/296, 297, 300, 301, 297/445, 349, DIG. 2; 248/188.7

[56] References Cited

U.S. PATENT DOCUMENTS

| | | | |
|---|---|---|---|
| 3,019,051 | 1/1962 | Nugent | 297/297 X |
| 3,197,165 | 7/1965 | Gits | 248/188.7 X |
| 3,363,943 | 1/1968 | Getz et al. | 297/DIG. 2 |
| 4,152,023 | 5/1979 | Buhk | 297/445 X |

FOREIGN PATENT DOCUMENTS

| | | | |
|---|---|---|---|
| 693047 | 8/1930 | France | 297/349 |
| 1055191 | 10/1953 | France | 297/297 |

*Primary Examiner*—Peter P. Nerbun

*Attorney, Agent, or Firm*—Kane, Dalsimer, Kane, Sullivan and Kurucz

[57] ABSTRACT

An upholstered chair is disclosed in which a first bent rod forms a frame for supporting the back and seat sections and in which a second rod is bent into a spider that supports the first rod. The first rod has a back section with a greater degree of flexibility than its seat section.

7 Claims, 10 Drawing Figures

54
64
58
66
20
56
52
22
24
102
104
98
28
106
100

122
120
104
126
116

54
36
34
40
50
20
44
46
52
32
42
30
48
38
70
72
78
74
80
68
22
82
76
88
94
24
110
102
96
100
104
98
106

FIG. 8
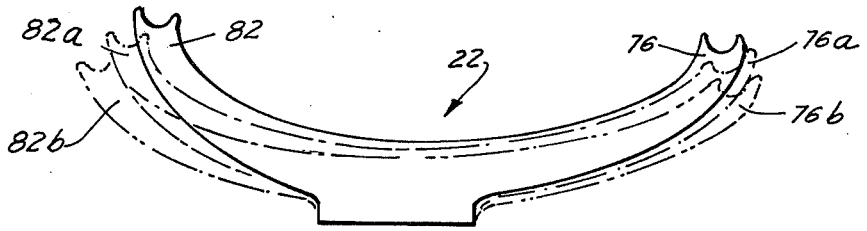
FIG. 10
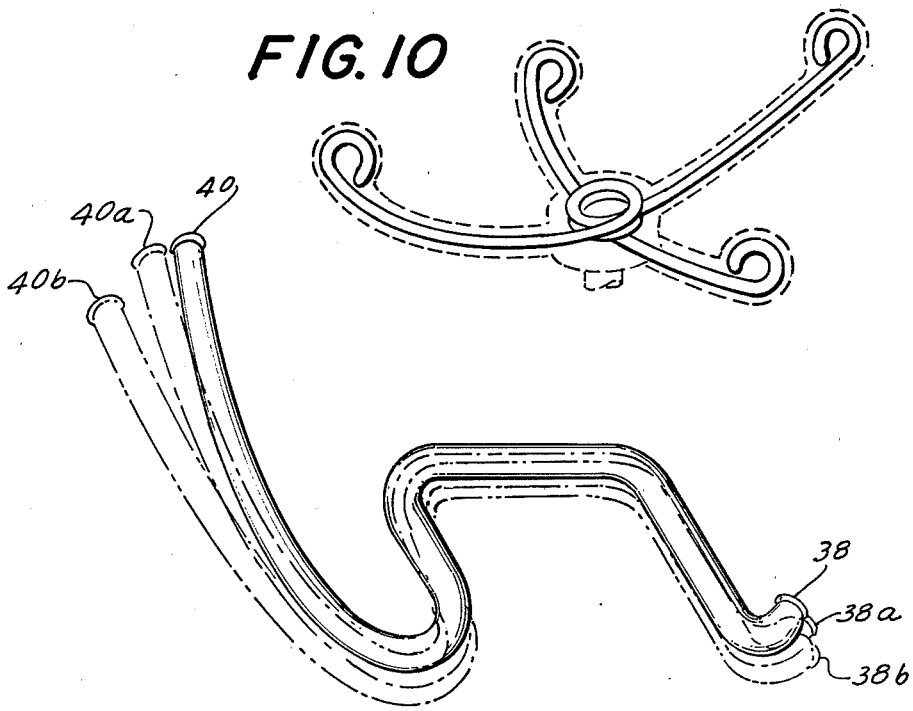
FIG. 9

CHAIR

BACKGROUND OF THE INVENTION

Their are many upholstered chairs available today for home and office use of varying designs. The chairs available are such that in order for a chair to be comfortable with a luxurious "feel" it is expensive due to manufacturing and material costs and the parts are designed and assembled so that any damage to chair or upholstery can be repaired only by specialists with specialized equipment and at large cost.

There exists a need for a relatively inexpensive upholstered chair of luxurious feel and that will lend itself to reupholstering and other repairs at limited cost.

SUMMARY OF THE INVENTION

The present invention provides a chair of luxurious feel which can have seat and back of upholstery that can be easily and inexpensively replaced or changed and without the necessity of expensive tools or skilled workmanship. The chair of this invention can be readily and inexpensively fabricated out of relatively few and inexpensive parts and provides the feel and cushioning effect when the user sits in it which is achieved usually by only very expensive upholstered chairs.

BRIEF DESCRIPTION OF THE DRAWINGS

FIG. 8 is a segmentary view of the chair spider illustrating its flex capabilities in broken lines;

FIG. 9 is a segmentary view of the chair frame illustrating its flex capabilities in broken lines; and FIG. 10 is a detail of the steel rod which forms the main portion of the spider shown in perspective view.

DESCRIPTION OF THE PREFERRED EMBODIMENT

Figure 1:
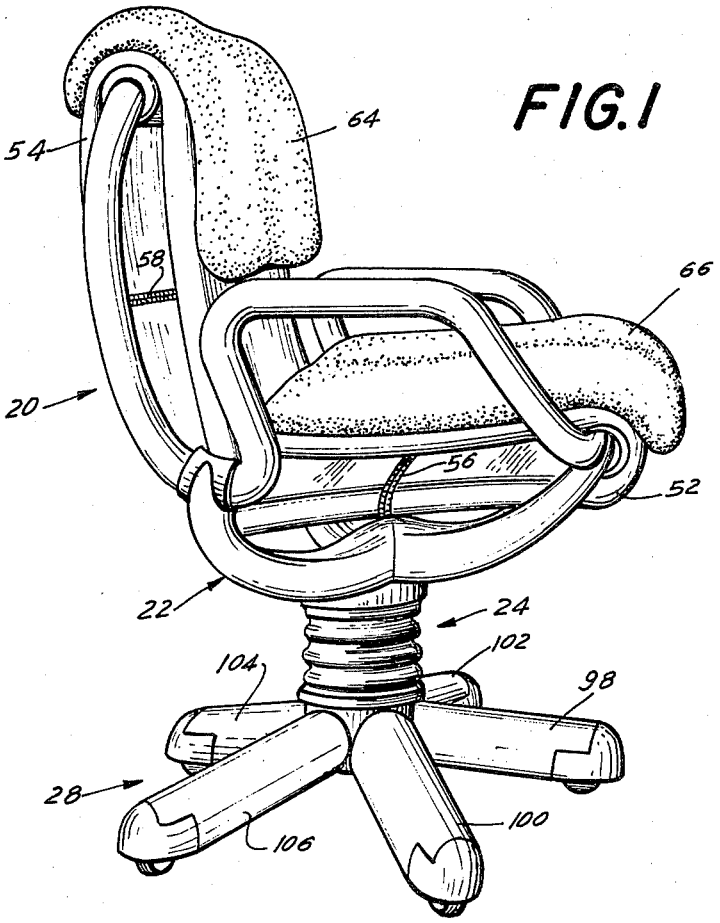
FIG. 1 is a front perspective view of a chair constructed in accordance with the teachings of this invention.

The chair which is the subject of this invention, as shown in the FIGURES, is comprised of integrally formed frame 20, spider 22, pedestal 24, leg member 28 and various components associated with each which will be described below.

The frame 20 is formed of bendable steel rod 30 inserted within hollow rubber tube 32. The rod with the tube on it is then formed into the desired configuration by bending and ends 34 and 36 thereof juxtapositioned. As an alternative it may be desirable to form the rod first and then slip rubber tube 22 over it or form the rubber on the rod in some other manner. Prior to bending into position soft rubber or foam tubular seat support member 38 can be slipped thereon as desired. In the later part of the frame folding operation a similar back support member 40 can be placed in position.

Additional seat and back support members 42 and 44 respectively, similar to the seat and back support members 38 and 40, are supported by bent steel rod 46, which are mounted to the frame 20 by two heavy rubber endless bands 48 and 50.

The upholstery system includes seat and back belts 52 and 54 respectively which are drawn over the respective seat and back support members and made endless by respective zippers 56 and 58.

In the embodiment shown these members are elastomer encased in fabric. The back and seat can be identical or different. If more "give" is desired in the back for comfort the fabric can have a high content of elastomeric fibers and the seat fabric provided in non stretch nylon. The entire upholstery system can be removed and replaced by the owner without need of special tools or training in view of the design and operation of the zipper.

An additional comfort consideration is added in the provision of head and seat rest members 64 and 66 which are injection molded urethane foam members which are layed into position. These are bulky members providing additional comfort to the user of the chair and avoiding annoyance due to pressing against tthe rod support members.

Spider 22 is provided to support frame 20 which is received in grooves 68, 70, 72 and 74 of arms 76, 78, 80 and 82 respectively and maintained in position by glue, adhesive or other suitable means.

The spider 22 is formed of a flexible rubber outer thick skin 84 cast over bent flexible steel rod 86. If desired the spider arms can be designed so that arms 80 and 82 which support the rear portion of the seat of the frame 20 are thinner and more flexible than the arms 76 and 78 which support the front portion so that there is more flexibility in the rear and the user is presented with a soft cushioned feeling when contacting the seat.

The flexing of the spider and frame when one sits in the chair is illustrated in FIGS. 8 and 9 respectively.

In FIG. 8 the spider arms 76 and 82 are indicated in solid lines. This is the normal position of these arms when the chair is empty. Arms 78 and 80 assume positions similar to those of arms 76 and 82 in this condition. The broken lines indicated by the numerals **76*a* and 82*a* illustrate an intermediate arm position and the broken lines indicated by the numerals 76*b* and 82*b* illustrate the ultimate position of arms with a person in the chair. It is noted that in the intermediate and in the final position the arm 82 undergoes greater flexing and greater movement from at rest position than does arm 76 in the embodiment shown. Arms 78 and 80** respectively behave similarly.

The action of frame 20 upon one sitting in the chair is illustrated in FIG. 9 wherein normal unmounted frame position is shown in solid lines and the relative positions of members 38 and 40 indicated. An intermediate and the final position of members 38 and 40 are shown in broken lines and indicated by the numerals **38*a* and 40*a* and 38*b* and 40*b*** respectively illustrating a greater degree of flex in the chair back than the chair seat for comfort purposes.

In the frame the greater flex in the back than the seat is achieved primarily by the dimensions since the frame unlike the spider arms has the same crosssection throughout.

As pointed out above, the spider 22 in the final assembly, while supporting the frame 20 is itself supported by pedestal 24 set in leg member 28.

Figure 4:
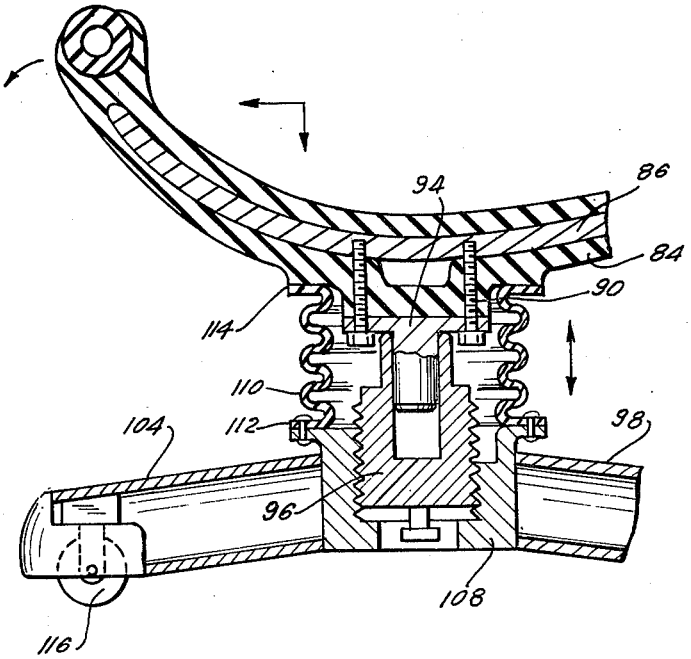
FIG. 4 is a partially sectional segmentary view of the chair of FIG. 1 showing the interconnection of frame, spider pedestal and legs.

As seen in the FIGURES and especially FIG. 4 the molded skin 84 of the spider has a depending flat circular surface 88 whereat screws 90 passing through head 92 of screw member 94 enter the spider and secure screw member 94 thereto. The leg member includes a metal collar 96 having an end each of tubes 98, 100, 102, 104 and 106 welded thereto so that the tubes project radially therefrom as legs. Threaded insert 108 is contained within the collar and receives screw member 94 so that relative rotation of spider and leg member will raise or lower the seat as desired. A flexible bellows 110 is fastened to the upper flange surface 112 of collar 96 with its upper end abutting shoulder 114 of the spider to enclose the threaded members. The design allows for relative rotation between the bellows and shoulder 114 so that raising and lowering are not impeded.

Figure 6:
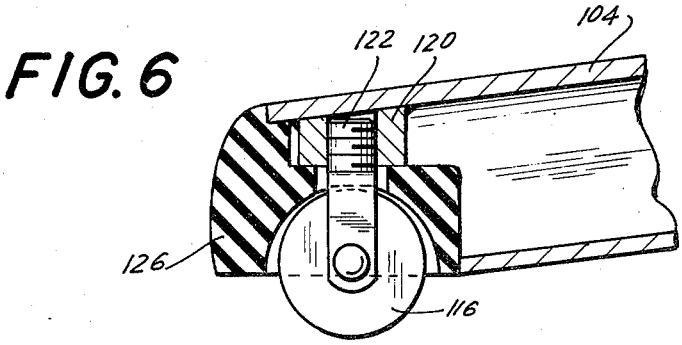
FIG. 6 is a partially sectional segmentary view illustrating a caster insert to a leg of the chair.
Figure 2:
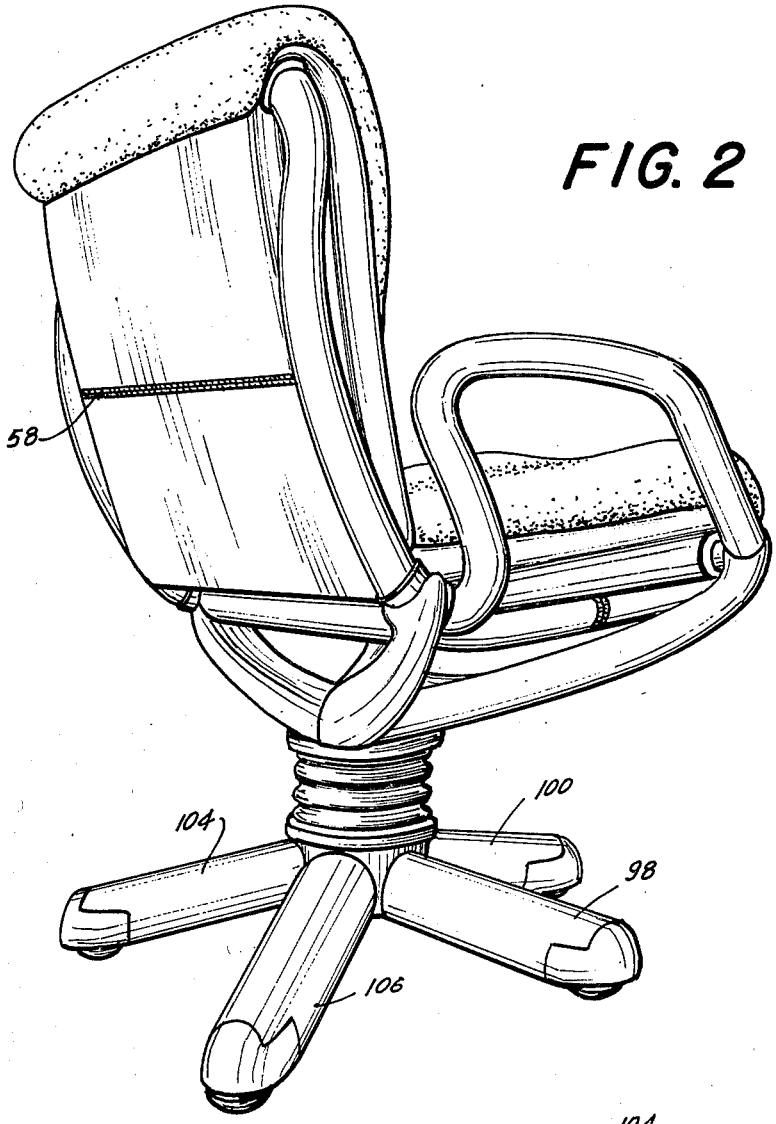
FIG. 2 is a rear perspective view of the chair shown in FIG. 1.
Figure 7:
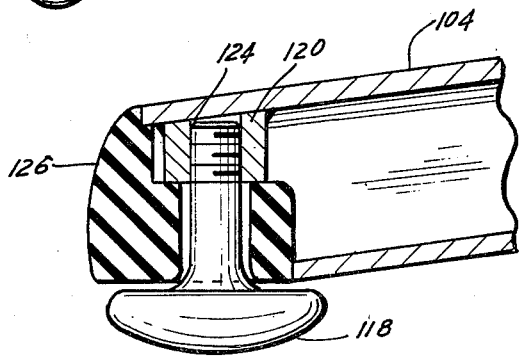
FIG. 7 is a view similar to that of FIG. 6 illustrating a glide insert to a leg of the chair as an alternative.
Figure 3:
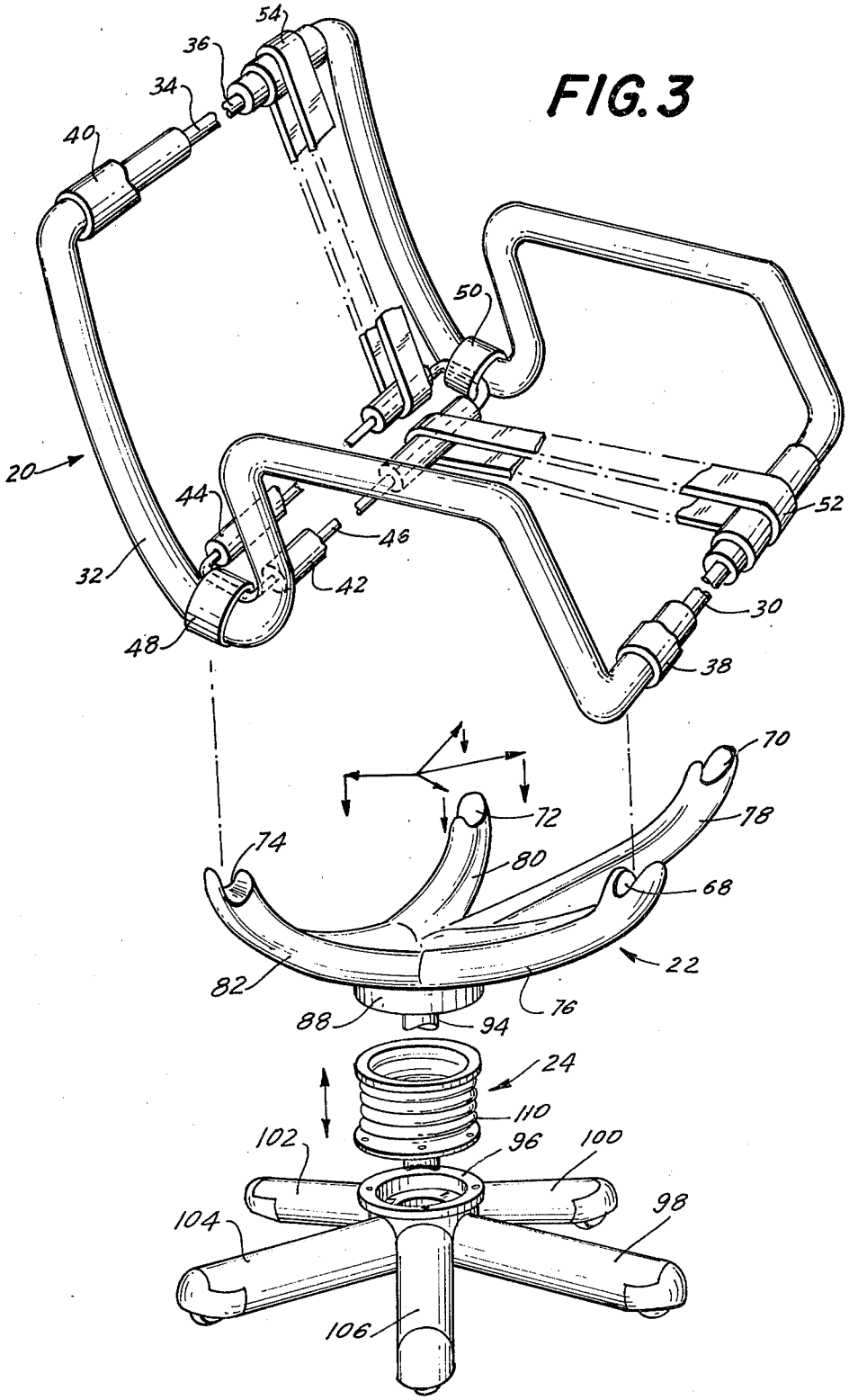
FIG. 3 is an exploded perspective segmentary view of portions of the chair shown in FIG. 1.
Figure 5:
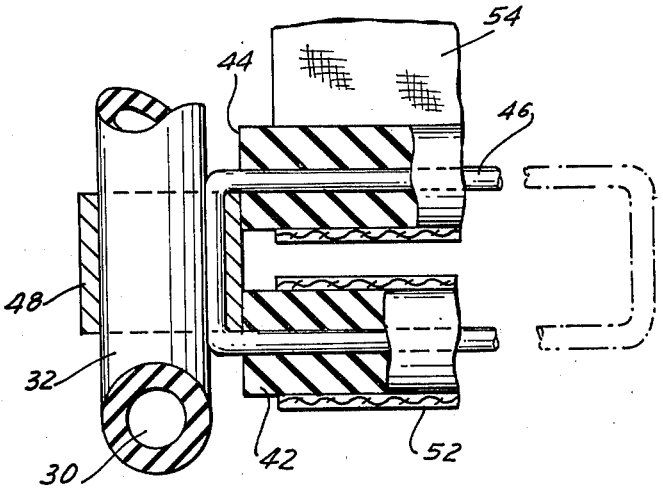
FIG. 5 is a partially sectional segmentary view of the connection of seat and back support members to the frame.

Each of the outer extremities of legs 98, 100, 102, 104 and 106 is designed to receive a suitable floor engaging member such as caster 116 as shown in FIG. 6 or glide 118 as shown in FIG. 7. As seen in those views the floor engaging member is attached to the leg by means of a stud 120 having a threaded insert. The stud is welded to the leg 104 and to receive the screw which is part of the floor engaging member. Thus in FIG. 6 the screw 122 of caster 116 is engaged with the threaded insert of stud 120 welded to leg 104 while in FIG. 7 the screw 124 of glider 118 is engaged with the threaded insert of stud 120 welded to leg 104. In each case a rubber bumper member 126 is inserted and glued in the leg end to protect the leg end and also to protect any surface that the chair might be pushed into when in use, such as a desk or a cradensa base.

Thus there has been described a chair formed of unitary integral parts which are simple and inexpensive to make but will present a luxurious appearance and feel when in use and one in which the upholstery may be readily changed.

I claim:

1. A chair structure including in combination a first rod within an elastomeric tubular member bent into configuration to provide a frame of said chair, a rod means bent into the configuration of a spider with arms engaging and supporting said first rod and pedestal support means supporting said second rod above an underlying surface a third rod attached to and supported by said first rod transverse of said frame and seat and back members respectively supported by said first rod and said third rod, and in which said third rod has first and second parallel legs, said first leg and said first rod supporting said seat member and said second leg and said first rod supporting said back member.

2. A chair in accordance with claim 1 in which said seat and back members respectively include seat and back belts respectively which are drawn over the respective first and second legs.

3. A chair in accordance with claim 2 in which the seat and back belts are endless.

4. A chair in accordance with claim 2 in which the seat and back belts include zipper means whereby said belts are made endless.

5. A chair in accordance with claim 4 in which said seat belt includes non stretch fibers and said back belt includes elastomeric fibers.

6. A chair structure including in combination a first rod bent into configuration to provide a frame of said chair, a rod means bent into the configuration of a spider with arms engaging and supporting said first rod and pedestal support means supporting said second rod above an underlying surface and in which said first rod is bent to have a seat section and a back section and said spider has seat supporting arms and back supporting arms which are more flexible than said seat supporting arms.

7. A chair structure including in combination a first rod bent into configuration to provide a frame of said chair, a rod means bent into the configuration of a spider with arms engaging and supporting said first rod and pedestal support means supporting said second rod above an underlying surface and in which said first rod is bent to have a back section and a seat section dimensioned whereby said back section has a greater degree of flexibility than said seat section and said spider has seat supporting arms and back supporting arms which are more flexible than said seat supporting arms.

* * * * *